United States Patent [19]

Yoshizawa et al.

[11] Patent Number: 5,069,731

[45] **Date of Patent: * Dec. 3, 1991**

[54] LOW-FREQUENCY TRANSFORMER

[75] Inventors: Yoshihito Yoshizawa; Kiyotaka Yamauchi, both of Saitama, Japan

[73] Assignee: Hitachi Metals, Ltd., Tokyo, Japan

[ * ] Notice: The portion of the term of this patent subsequent to Nov. 21, 2006 has been disclaimed.

[21] Appl. No.: 327,882

[22] Filed: Mar. 23, 1989

[30] Foreign Application Priority Data

Mar. 23, 1988 [JP] Japan ..... 63-68825

[51] Int. Cl.[5] ..... H01F 1/04

[52] U.S. Cl. ..... 148/305; 148/306; 148/307; 420/89; 336/213; 336/234

[58] Field of Search ..... 148/304, 305, 306, 307; 420/89, 83, 121; 336/213, 234

[56] References Cited

U.S. PATENT DOCUMENTS 4,581,080 4/1986 Meguro et al. ..... 148/307
4,881,989 11/1989 Yoshizawa et al. ..... 148/302

FOREIGN PATENT DOCUMENTS 0271657 6/1988 European Pat. Off. ..... 148/305
63-239906 10/1988 Japan ..... 148/305

*Primary Examiner*—John P. Sheehan
*Attorney, Agent, or Firm*—Sughrue, Mion, Zinn, Macpeak & Seas

[57] ABSTRACT

A low-frequency transformer including a magnetic core made of an alloy having the composition represented by the general formula:

$$(Fe_{1-a}M_a)_{100-x-y-z-\alpha}Cu_xSi_yB_zM'_\alpha \quad \text{(atomic \%)}$$

wherein M is Co and/or Ni, M′ is at least one element selected from the group consisting of Nb, W, Ta, Mo, Zr, Hf and Ti, and a, x, y, z and $\alpha$ respectively satisfy $0 \leqq a \leqq 0.3$, $0.1 \leqq x \leqq 3$, $0 \leqq y \leqq 17$, $4 \leqq z \leqq 17$, $10 \leqq y+z \leqq 28$ and $0.1 \leqq \alpha \leqq 5$, at least 50% of the alloy structure being occupied by fine crystal grains having an average grain size of 1000 Å or less when measured by their maximum diameters. The alloy may further contain at least one element selected from the group consisting of Ge, P, C, Ga, Al and N.

8 Claims, 4 Drawing Sheets

LOW-FREQUENCY TRANSFORMER

THE INVENTION

The present invention relates to a low-frequency transformer having a high saturation magnetic flux density and a low core loss, which is suitable for distribution transformers operable at a commercial frequency and inverter transformers operable at as low a frequency as 10 kHz or less.

Conventionally, silicon steel magnetic cores having high saturation magnetic flux densities and relatively low core losses have mainly been used as magnetic cores for distribution transformers operable at a commercial frequency and inverter transformers operable at as low a frequency as 10 kHz or less. Particularly at around a commercial frequency, 50% or more of the core loss is often caused due to a hysteresis loss. Accordingly, magnetic cores preferably have as small coercive forces as possible. Examples of such silicon steel magnetic materials are disclosed in Japanese Patent Publication Nos. 62-37090, 62-37688 and 62-45285. They are subjected to rolled annealing to cause recrystallization, etc., thereby increasing their magnetic flux densities and decreasing their core losses.

In recent years, the development of rapid quenching technologies such as a single roll method has made it possible to produce high-silicon steel thin ribbons and Fe-base amorphous alloy thin ribbons both having low core losses. They have come to attract much attention as materials for low-frequency transformers. Particularly, since the Fe-base amorphous alloys have as small core losses as about one-third those of the silicon steel at a commercial frequency, they have attracted much attention as energy-saving materials, and they have partially been put to practical use for distribution transformers, etc. See Japanese Patent Laid-Open No. 62-188748, and Denki Gakkaishi, Vol. 108, No. 1, 1988, p.41.

However, the silicon steel is not satisfactory as core materials for transformers in terms of energy saving, heat generation, etc., because it does not have a sufficiently low core loss.

With respect to the Fe-base amorphous alloys, they have fully low core losses, but they are disadvantageous in that they have extremely large magnetostriction, which makes them highly susceptible to stress. Accordingly, their magnetic properties are deteriorated by mechanical vibration, deformation due to their own weights, etc. In addition, their magnetic properties are also likely to be deteriorated with the time.

The high-silicon steel is extremely brittle when formed into thin ribbons or sheets, so that they are not easily wound to toriodal cores or cut to provide laminated cores. In respect to core loss, too, it is considerably inferior to the amorphous alloys.

OBJECT AND SUMMARY OF THE INVENTION

An object of the present invention is to provide a highly reliable low-frequency transformer having a relatively high saturation magnetic flux density, a high core loss in a low frequency region of 10 kHz or less, small magnetostriction, small variation of magnetic properties with time, and small energy consumption.

As a result of intense research in view of the above object, the inventors of the present invention have found that excellent properties such as relatively high saturation magnetic flux densities, low core losses at low frequency, low magnetostriction and small variation with time, which are required for low-frequency transformers, are provided by a magnetic core made of an alloy having the composition represented by the general formula:

$$(Fe_{1-a}M_a)_{100-x-y-z-\alpha}Cu_xSi_yB_zM'_\alpha \quad \text{(by atomic \%)}$$

wherein M is Co and/or Ni, M' is at least one element selected from the group consisting of Nb, W, Ta, Mo, Zr, Hf and Ti, and a, x, y, z and $\alpha$ respectively satisfy $0 \leqq a \leqq 0.3$, $0.1 \leqq x \leqq 3$, $0 \leqq y \leqq 17$, $4 \leqq z \leqq 17$, $10 \leqq y+z \leqq 28$, and $0.1 \leqq \alpha \leqq 5$, at least 50% of this alloy being composed of fine crystal grains having an average grain size of 1000Å or less when measured by their maximum diameters.

The low-frequency transformer according to another embodiment of the present invention comprises a magnetic core made of an alloy having the composition represented by the general formula:

$$(Fe_{1-a}M_a)_{100-x-y-z-\alpha-\gamma}Cu_xSi_yB_zM'_\alpha X_\gamma \quad \text{(atomic \%)}$$

wherein M is Co and/or Ni, M' is at least one element selected from the group consisting of Nb, W, Ta, Mo, Zr, Hf and Ti, X is at least one element selected from the group consisting of Ge, P, C, Ga, Al and N, and a, x, y, z, $\alpha$ and $\gamma$ respectively satisfy $0 \leqq a \leqq 0.3$, $0.1 \leqq x \leqq 3$, $0 \leqq y \leqq 10$, $4 \leqq z \leqq 17$, $0.1 \leqq \alpha \leqq 5$, $\gamma \leqq 4$ and $10 \leqq y+z+\gamma \leqq 20$, at least 50% of the alloy structure being occupied by fine crystal grains having an average grain size of 1000Å or less when measured by their maximum diameters.

DETAILED DESCRIPTION OF THE INVENTION

Figure 1:
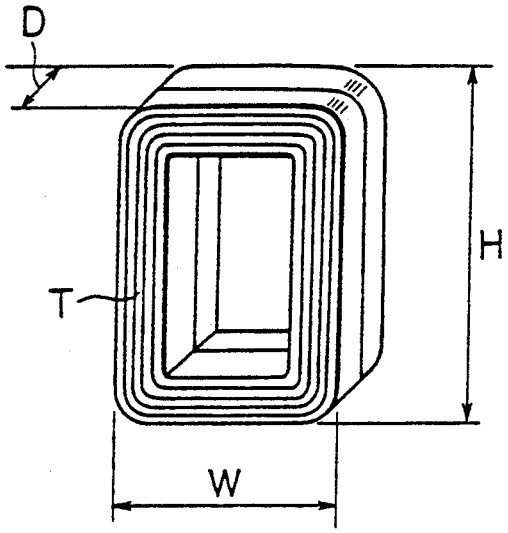
FIG. 1 is a perspective view of a magnetic core according to one embodiment of the present invention.

In the present invention, Cu is an indispensable element, and its content (x) is 0.1–3 atomic %. When it is less than 0.1 atomic %, substantially no effect in the reduction of the core loss can be obtained by the addition of Cu. On the other hand, when it exceeds 3 atomic %, the alloy is already brittle before heat treatment, so that it cannot be easily worked. The particularly preferred content of Cu in the present invention is 0.5–2 atomic %, in which range the core loss is particularly small.

The alloy according to the present invention can be usually produced by forming an amorphous alloy of the above composition by rapid quenching methods such as a single roll method, a double roll method, etc., and then heat-treating the amorphous alloy to generate fine crystal grains.

The fine crystal grains generated by heat treatment are mainly composed of a bcc Fe solid solution having an average grain size of 1000Å or less, and they are uniformly dispersed in the alloy structure. Good soft magnetic properties can be obtained when the average grain size is 500Å or less. Particularly, the alloy tends to show excellent soft magnetic properties when its average grain size is 20–200Å.

The remaining portion of the alloy structure other than the fine crystal grains is mainly amorphous. Incidentally, even if the fine crystal grains occupy substantially 100% of the alloy structure, the alloy shows sufficiently good magnetic properties.

Si and B are useful elements for making the alloy structure fine and for improving the alloys' soft magnetic properties and adjusting their magnetostriction. The alloys are desirably produced by once forming amorphous alloys with the addition of Si and B, and then heat-treating them to form fine crystal grains.

The content of Si (y) is limited to 0–17 atomic % because when y exceeds 17 atomic %, the alloy becomes too brittle.

The content of B (z) is limited to 4–17 atomic %. When z is less than 4 atomic %, a uniform crystal grain structure is not easily obtained, resulting in increase in the core loss at a low frequency, and when z exceeds 17 atomic %, the magnetostriction becomes unfavorably large under the heat treatment conditions for providing the alloys with good soft magnetic properties.

With respect to the total amount of Si and B [y+z], when y+z is less than 10 atomic %, the core loss becomes too large. And when y+z is more than 28 atomic %, the saturation magnetic flux density extremely decreases, and the core loss and the magnetostriction increase.

Preferable contents of Si and B are $0 \leqq y \leqq 15$, $7 \leqq z \leqq 15$ and $15 \leqq y+z \leqq 25$, in which ranges alloys having low core losses at low frequency can be easily obtained.

In the present invention, M' acts, when added together with Cu, to make the precipitated crystal grains fine. M' is at least one element selected from the group consisting of Nb, W, Ta, Zr, Hf, Ti and Mo. The content of M' ($\alpha$) is 0.1–5 atomic %. This is because when $\alpha$ is less than 0.1 atomic %, alloys having low core losses cannot easily be obtained, and when $\alpha$ exceeds 5 atomic %, an extreme decrease in the saturation magnetic flux density ensues, thus making them unsuitable for low-frequency transformers. The preferable range of $\alpha$ is 1–3 atomic %, in which range alloys having high saturation magnetic flux densities and low core losses can be obtained.

The alloys used for the low-frequency transformers according to the present invention may contain 4 atomic % or less of at least one element X selected from the group consisting of Ge, P, C, Ga, Al and N. These elements not only are effective for making the alloy amorphous, but also when added together with Si and B, they are effective for adjusting the magnetostriction and the saturation magnetic flux densities of the alloys. The preferred amount of X is 0.1–3 atomic %.

The balance of the alloy is substantially Fe with the exception of impurities, but a part of Fe may be substituted by additional components M consisting of Co and/or Ni. The content of M (a) is 0–0.3 because when "a" exceeds 0.3, the magnetostriction becomes large and the core loss is increased.

Incidentally, with respect to inevitable impurities such as O, As, Bi, Pb, H, K, Na, Ca, Ba, Mg, etc., it is to be noted that their existence in such amounts as not to deteriorate the desired properties is not regarded as changing the alloy composition.

The alloys may further contain Cr, Mn, V or Zn alone or in combination. The total amount of these elements is 2 atomic % or less. These elements serve to improve the corrosion resistance and adjust the magnetic properties of the alloy. However, since they tend to reduce the saturation magnetic flux density, they should be less than 2 atomic % in the application of low-frequency transformers.

The saturation magnetic flux density of the above alloy is usually 10 kG or more, but it is desirably 13 kG or more for the purpose of miniaturizing the transformers.

In sum, the compositions of the alloys which may be used in the present invention are as follows:

$(Fe_{1-a}M_a)_{100-x-y-z\alpha}Cu_xSi_yB_zM'_\alpha$ $0 \leqq a \leqq 0.3$
$0.1 \leqq x \leqq 3$
$0 \leqq y \leqq 17$
$4 \leqq z \leqq 17$
$10 \leqq y+z \leqq 28$
$0.1 \leqq \alpha \leqq 5.$ Preferably, $0 \leqq a \leqq 0.3$
$0.5 \leqq x \leqq 2$
$0 \leqq y \leqq 15$
$7 \leqq z \leqq 15$
$15 \leqq y+z \leqq 25$
$1 \leqq \alpha \leqq 3.$ $(Fe_{1-a}M_a)_{100-x-y-z\alpha-\gamma}Cu_xSi_yB_zM'_\alpha X_\gamma$ $0 \leqq a \leqq 0.3$
$0.1 \leqq x \leqq 3$
$0 \leqq y \leqq 10$
$4 \leqq z \leqq 17$
$0.1 \leqq \alpha \leqq 5.$
$\gamma \leqq 4$
$10 \leqq y+z+\gamma \leqq 20.$ Preferably, $0 \leqq a \leqq 0.3$
$0.5 \leqq x \leqq 2$
$0 \leqq y \leqq 10$
$7 \leqq z \leqq 15$
$1 \leqq \alpha \leqq 3$
$0.1 \leqq \gamma \leqq 3$
$10 \leqq y+z+\gamma \leqq 20.$ The alloy used in the present invention may be produced by the following procedure. First, an amorphous ribbon usually having a thickness of 50 μm or less may be produced by a single roll method, a double roll method, etc., and then heat-treated to generate fine crystal grains.

The heat treatment is usually carried out in vacuum or in inert gas atmospheres such as hydrogen, nitrogen, argon, etc, but it may be carried out in an oxidizing atmosphere such as the air depending upon circumstances.

The heat treatment temperature and time may vary depending upon the composition of the amorphous alloy ribbon and the shape and the size of a magnetic core constituted by the amorphous alloy ribbon, etc., but in general, it is preferably conducted at 450°–700° C. for 5 minutes to 24 hours.

In the heat treatment, the heating and cooling conditions can be properly changed depending on the circumstances. It is possible to conduct several cycles of heat treatments at the same temperature or at different temperatures. And heat treatment may also be conducted by a heat-treating pattern consisting of a plurality of steps. Further, the heat treatment of the alloy may be carried out in a DC or AC magnetic field, providing the alloy with magnetic anisotropy.

The magnetic field need not always be applied during the entire heat treatment period, and it may be applied at any time while the heat treatment temperature is lower than the Curie temperature Tc of the alloy. In addition, a rotational magnetic field can be applied during the heat treatment. Further, the alloy can be heat-treated by passing an electric current through the alloy during heat treatment or placing it in a high-frequency magnetic field during heat treatment. It may also be conducted by applying tension or compression force, thereby adjusting the magnetic properties of the alloy.

To further reduce the core loss, the magnetostriction may be divided by introducing partial defects or strain into the alloy ribbon by partial scratching or irradiation of laser beams.

The magnetic cores used in the present invention include wound cores, laminated cores, etc. It is desirable to form an insulating layer partially or entirely on the surface of an alloy ribbon, because this serves to reduce the core loss. Of course, the insulating layer can be formed on one side or both sides of the alloy ribbon.

The insulating layer can be formed by attaching insulating powder such as $SiO_2$, MgO, $Al_2O_3$, $Cr_2O_3$, etc. to the ribbon surface by an immersion method, a spraying method, an electrophoresis method, etc. A thin layer of $SiO_2$, nitrides, etc. may also be formed by a sputtering method or a vapor deposition method. Alternatively, a mixture of a solution of modified alkylsilicate in alcohol with an acid may be applied to the ribbon. Further, a forsterite ($Mg_2SiO_4$) layer may be formed by heat treatment. Further, a sol obtained by partially hydrolyzing $SiO_2$-$TiO_2$ metal alkoxide may be mixed with various ceramic powder, and the resulting mixture may be applied to the ribbon, dried and then heated. Further, an alloy ribbon may be coated with or immersed in a solution consisting mainly of Tirano polymer and then heated to form an insulating layer. Further, a heat treatment may be conducted to form an oxide layer of Si, etc. or a nitride layer on the surface of the alloy ribbon.

In the case of the wound core, it can be formed by laying an insulating tape on the alloy ribbon and winding them, thereby providing insulation between the alloy sheet layers. The insulating tape may be a polyimide tape, a ceramic fiber tape, a polyester tape, an aramide tape, etc.

In the case of the laminated core, an insulating thin film may be inserted between every layer or every few layers to achieve insulation between the alloy sheet layers. In this case, materials having no flexibility may be used for the insulating thin film, such as ceramic sheets, glass sheets, mica sheets, etc. After lamination, it is bonded together under pressure while heating.

The magnetic cores for the transformers of the present invention do not suffer from extreme deterioration of magnetic properties even when they are impregnated, which is usually experienced by conventional magnetic cores made of Fe-base amorphous alloys. The impregnants include epoxy resins, polyimide resins, varnishes based on modified alkylsilicates, silicone resins, etc.

The alloy ribbons may be cut to form cut cores, and they are bonded by usual methods such as a step lap bonding method, an inclined butt bonding method, etc.

In the production of transformers, the magnetic cores constituted by the alloy ribbons may be immersed in oils such as silicone oils, etc. to prevent their rusting.

Further, when the magnetic cores are large ones, they may be tightened with metal belts to prevent their deformation and damaging.

Insulating tapes may be wrapped around the magnetic cores to prevent rust and damage and to provide electric insulation.

The present invention will be explained in detail by the following Examples, without intention of restricting the scope of the present invention.

EXAMPLE 1

An alloy melt having a composition (by atomic %) of $Fe_{76}Cu_1Si_{13.5}B_7Nb2.5$ was formed into a ribbon of 75 mm in width and 25 μm in thickness by a single roll method. The observation of its microstructure by a transmission electron microscope confirmed that the alloy structure was mostly composed of extremely fine crystal grains having an average grain size of 500Å or less.

Figure 2:
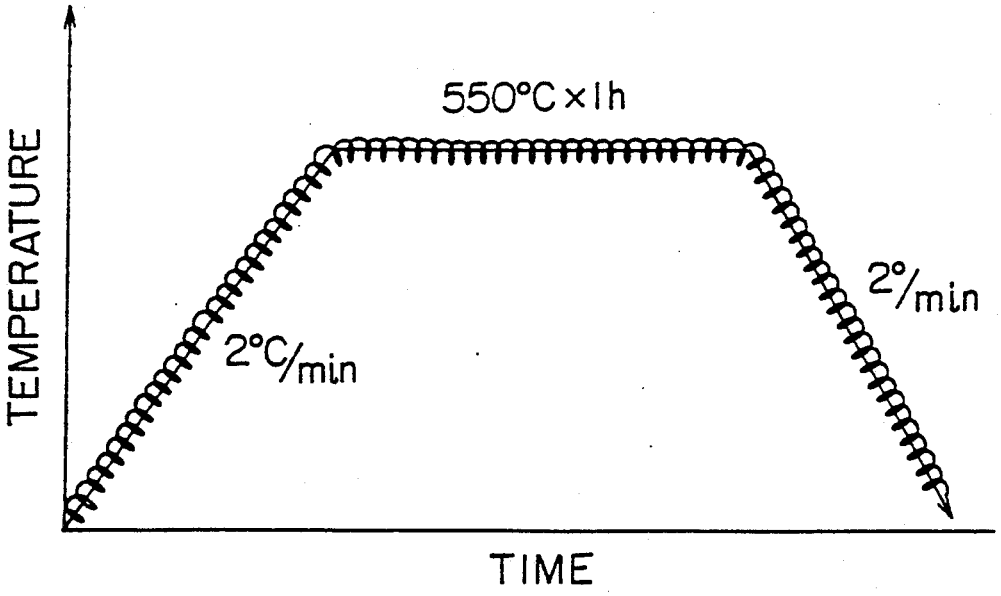
FIG. 2 is a graph schematically showing the heat treatment of the alloy according to the present invention.

This amorphous ribbon was coated with an insulating layer of MgO on its surfaces by an electrophoresis method, and formed into a toroidal core, and two toroidal cores were assembled as shown in FIG. 1, in which H=390 mm, W=250 mm, D=150 mm and T=95 mm. Next, it was heat-treated in an $N_2$ gas atmosphere while applying a magnetic field of 10 Oe in the direction parallel to the magnetic path during the overall period of the heat treatment. The heat treatment pattern was as shown in FIG. 2. The alloy ribbon was heated to 550° C. at a heating rate of 2 ° C./min, kept at 550° C. for 1 hour, and then cooled at an average cooling rate of 2 ° C./min to room temperature.

The heat-treated magnetic core had a saturation magnetic flux density Bs of 13.5 kG, a squareness ratio Br/Bs of 94%, and a DC coercive force Hc of 0.009 Oe. Further, its saturation magnetostriction constant $\lambda_s$ was $+2.3\times10^{-6}$, which is less than one-tenth those of the conventional Fe-base amorphous alloys for distribution transformers.

In addition, it showed a core loss of 0.06 W/kg at 50 Hz, and at maximum magnetic flux density Bm of 12 kG, which is comparable to those of the Fe-base amorphous alloys. Thus, it has been confirmed that it is suitable for low-frequency transformers.

EXAMPLE 2

An alloy melt having a composition (by atomic %) of $Fe_9Cu_1Si_4B_{13}Nb_3$ was formed into a ribbon of 25 mm in width and 18 μm in thickness by a single roll method. This amorphous ribbon was wound to a toroidal form of 105 mm in outer diameter and 100 mm in inner diameter. It was heat-treated in an Ar gas atmosphere such that the alloy ribbon was heated to 550° C. at a heating rate of 20 ° C./min, kept at 550° C. for 1 hour, and then air-cooled to room temperature by taking it out of the furnace. A magnetic field of 3 Oe was being applied in the direction parallel to the magnetic path in a period from 10 minutes before taking it out of the furnace.

The heat-treated magnetic core had a saturation magnetic flux density Bs of 15.0 kG, a squareness ratio Br/Bs of 85%.

Figure 3:
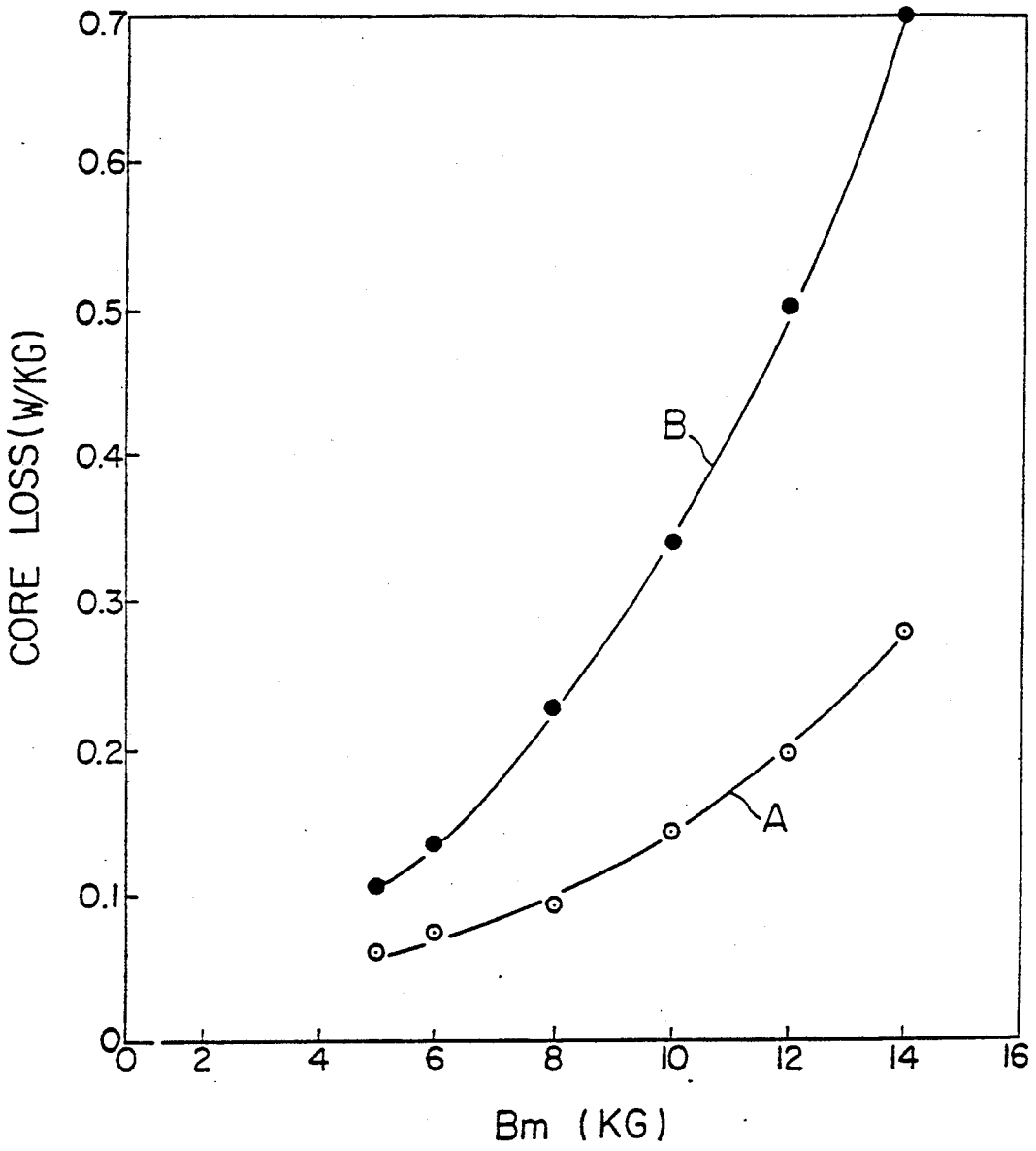
FIG. 3 is a graph showing the relations between core loss and $B_m$.

FIG. 3 shows the dependency of core loss on $B_m$ at 50 Hz for the above alloy (A) and directional silicon steel (B). The alloy A shows smaller core loss than the directional silicon steel B. Accordingly, the alloy A is suitable for transformers operable at a commercial frequency.

Incidentally, the observation of its microstructure by a transmission electron microscope confirmed that the alloy structure was substantially the same as in Example 1.

EXAMPLE 3

Amorphous alloy ribbons of 25 mm in width and 18 μm in thickness and having compositions shown in Table 1 were produced by a single roll method. Each amorphous ribbon was wound into a toroidal form having an outer diameter of 110 mm and an inner diameter of 100 mm. Each wound core was heat-treated in the same manner as in Example 1. In the heat-treated alloy, most of the alloy structure was occupied by extremely fine crystal grains having an average grain size of 500Å or less.

Next, each of these magnetic cores was contained in a Derlin core case, and 250 turns of windings were provided both on primary and secondary sides. The core loss of each magnetic core was measured at 50 Hz and 12 kG. The results are shown in Table 1.

TABLE 1

| Sample No.[1] | Alloy Composition (atomic %) | Core Loss (W/kg) | $B_5$ (kG) |
|---|---|---|---|
| 1 | $Fe_{bal.}Cu_1Si_2B_{13}Nb_{4.5}$ | 0.18 | 14.8 |
| 2 | $Fe_{bal.}Cu_1Si_9B_{10}Mo_3$ | 0.15 | 14.8 |
| 3 | $Fe_{bal.}Cu_1Si_2B_{13}Ta_2$ | 0.24 | 15.8 |
| 4 | $(Fe_{0.99}Ni_{0.01})_{bal.}Cu_1Si_{10}B_9W_3$ | 0.18 | 14.0 |
| 5 | $(Fe_{0.87}Co_{0.13})_{bal.}Cu_1Si_6B_{10}Nb_{2.8}Zr_{0.5}$ | 0.17 | 14.9 |
| 6 | $Fe_{bal.}Cu_{1.5}Si_4B_{12}Nb_{2.5}Ti_{0.5}$ | 0.19 | 14.8 |
| 7 | $Fe_{bal.}Cu_{0.7}Si_6B_{10}Nb_{2.5}Ta_{0.5}$ | 0.22 | 15.5 |
| 8 | $Fe_{bal.}Cu_1Si_1B_{14}Nb_3Ge_1$ | 0.20 | 15.1 |
| 9 | $Fe_{bal.}Cu_1Si_{13}B_{7.5}Nb_3C_{0.1}$ | 0.06 | 13.0 |
| 10 | $Fe_{bal.}Cu_1Si_2B_{13}Nb_5Mn_{0.5}$ | 0.20 | 14.0 |
| 11 | $Fe_{bal.}Cu_{2.0}Si_{10}B_9Nb_3V_{0.5}$ | 0.16 | 13.7 |
| 12 | $Fe_{bal.}Cu_1Si_{12}B_8Nb_{2.5}Zn_{0.5}$ | 0.08 | 13.5 |
| 13 | $Fe_{bal.}Cu_{2.3}Si_{12.5}B_{8.5}Nb_3Sn_{0.5}$ | 0.07 | 13.2 |
| 14 | $Fe_{bal.}Cu_1Si_2B_{13}Nb_{2.7}Ga_1$ | 0.21 | 15.3 |
| 15 | $Fe_{78}Si_9B_{13}$Amorphous | 0.12 | 15.6 |
| 16 | Directional Silicon Steel | 0.5 | 20.0 |

Note:
[1]Sample Nos. 1-14: Present invention. Sample Nos. 15 and 16: Comparative Examples.

It is clear from Table 1 that the alloys of the present invention show low-frequency core losses which are much lower than that of the conventional silicon steel and comparable to that of the Fe-base amorphous alloy. Therefore, they are suitable for pole transformers, low-frequency inverter transformers, etc.

EXAMPLE 4

An alloy melt having a composition (atomic %) of $(Fe_{0.99}Co_{0.01})_{78.5}Cu_1Si_8B_9Nb_3Cr_{0.5}$ was rapidly quenched by a single roll method to form an amorphous alloy ribbon of 10 mm in width and 18 μm in thickness.

This ribbon was cut to 100 mm, and the resulting 10 thin plates were laminated and pressed while heating in the air to provide a laminate of about 0.2 mm in thickness.

Figure 4:
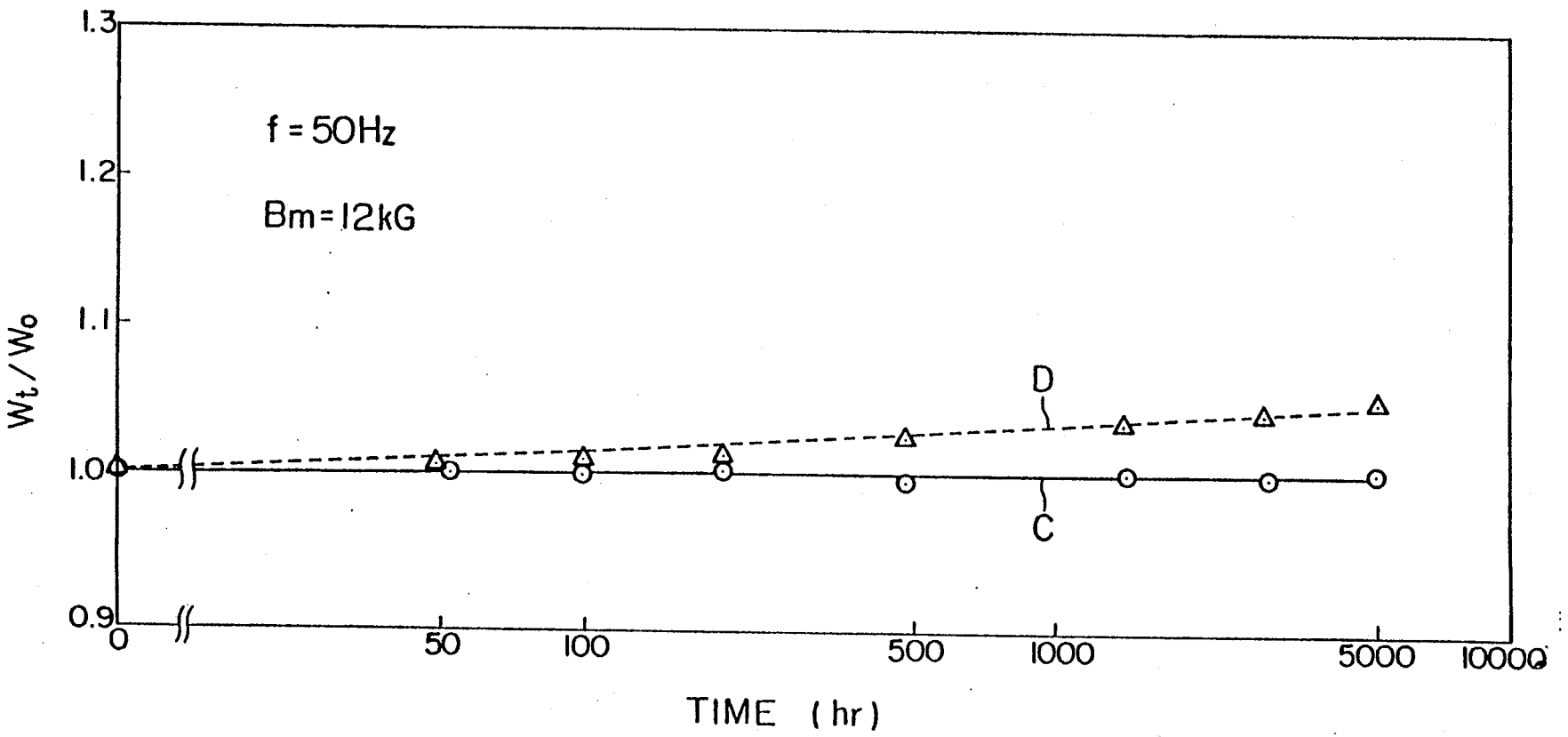
FIG. 4 is a graph showing the variation of core loss with time.

This laminate was then heat-treated at 550° C. in an Ar atmosphere while applying a magnetic field of 10 Oe in its longitudinal direction for 1 hour. After cooled to room temperature, its core loss was measured at 50 Hz and 14 kG by a single plate tester. Next, this laminate was placed in a constant-temperature furnace kept at 120° C. to measure the variation of its core loss with time. The results are shown in FIG. 4, in which $W_0$ denotes an initial core loss and $W_t$ denotes a core loss after the lapse of t hours. In FIG. 4, C denotes the alloy of $(Fe_{0.99}Co_{0.01})_{81.5}Cu_1Si_8B_9Nb_3Cr_{0.5}$, and D denotes an amorphous alloy of $Fe_{78}Si_9B_{13}$. Incidentally, the heat-treated alloy C had a fine crystal grain structure having an average grain size of 500Å or less as in Example 1.

As is clear from FIG. 4, substantially no variation of core loss with time was observed on the alloy C of the present invention.

EXAMPLE 5

An alloy having a composition (atomic %) of 1.5% Cu, 4% Si, 12% B, 3% Nb, 0.5% Al and balance substantially Fe was rapidly quenched by a single roll method to produce an amorphous alloy ribbon having a thickness of 20 μm and various widths. Each ribbon was wound in the form shown in FIG. 5, to produce a magnetic core having a circular cross section and a closed magnetic path. Each magnetic core was heat-treated in an $N_2$ gas atmosphere in a magnetic field. The heat-treated alloy had extremely fine crystal grains having an average grain size of 500Å or less.

Figure 5:
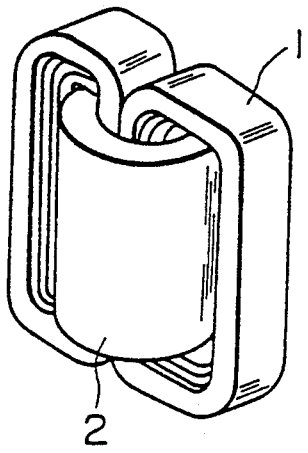
FIG. 5 is a schematic view of a magnetic core according to another embodiment of the present invention.

Next, the magnetic core was provided with windings both on primary and secondary sides to produce a distribution transformer as shown in FIG. 5, in which 1 denotes the magnetic core made of the alloy of the present invention and 2 denotes the windings. Its total loss was 14 % less than the conventional transformers using silicon steel, showing that the low-frequency transformer of the present invention is superior to the conventional ones.

Next, loss was measured after falling this transformer from a height of 30 cm, and there was substantially no change.

EXAMPLE 6

An alloy melt having a composition (atomic %) of 1% Cu, 12% Si, 9% B, 3% Nb 0.5% Ge and balance substantially Fe was rapidly quenched by a single roll method to form an amorphous alloy ribbon of 10 mm in width and 25 μm in thickness.

This ribbon was cut to 100 mm, and the resulting 10 thin plates were laminated and pressed while heating in the air to provide a laminate of about 0.3 mm in thickness.

This laminate was then heat-treated at 560 ° C. in an Ar atmosphere while applying a magnetic field of 30 Oe in its longitudinal direction for 1 hour. After cooled to room temperature, its core loss was measured at 50 Hz and 12 kG by a single plate tester. The measured core loss was 0.06 W/kg.

Next, the heat-treated ribbon was subjected to partial spot fusion in transverse direction on its free-solidification surface by a YAG laser to measure its core loss at 50 Hz and 12 kG. The measured core loss was 0.05 W/kg. This shows that the laser treatment reduces the core loss. The same effects could be obtained by partial scratching.

EXAMPLE 7

Alloy melts having compositions shown in Table 2 were formed into amorphous ribbons of 25 mm in width and 20 μm in thickness by a single roll method. Each amorphous ribbon was wound to a toroidal form having an outer diameter of 100 mm and an inner diameter of 80 mm. Next, it was heat-treated in an $N_2$ gas atmosphere while applying a DC magnetic field of 5 Oe in the direction parallel to the magnetic path during the overall period of the heat treatment. The heat treatment pattern was such that the alloy ribbon was heated to 530° C. at a heating rate of 2 ° C./min, kept at 550° C. for 1 hour, cooled at an average cooling rate of 2 ° C./min to 200° C., and then air-cooled to room temperature by taking it out of the furnace.

The heat-treated alloys had the same microstructures as in Example 1. The magnetic properties of the heat-treated alloys are shown in Table 2.

TABLE 2

| Sample No.(1) | Alloy Composition (atomic %) | $B_{10}$ (kG) | $H_c$ (Oe) |
|---|---|---|---|
| 17 | $Fe_{bal.}Cu_1Nb_3Si_4B_{11.5}Ge_1$ | 15.0 | 0.05 |
| 18 | $Fe_{bal.}Cu_1Nb_3Si_4B_{12.0}Ga_{0.5}$ | 15.2 | 0.06 |
| 19 | $Fe_{bal.}Cu_1Nb_3Si_{3.5}B_{12.5}Al_{0.5}$ | 15.1 | 0.08 |
| 20 | $(Fe_{0.99}Co_{0.01})_{bal.}Cu_1Mo_{0.5}Nb_3Si_4B_{12}N_{0.5}$ | 14.8 | 0.08 |
| 21 | $Fe_{bal.}Cu_1Ta_{0.5}Nb_3Si_4B_{12}C_{0.5}$ | 15.0 | 0.08 |
| 22 | $(Fe_{0.99}Ni_{0.01})_{bal.}Cu_1Cr_{0.1}Nb_3Si_7B_9P_1$ | 14.7 | 0.04 |
| 23 | $Fe_{bal.}Cu_{0.5}Nb_{2.5}Si_4B_{12}P_2$ | 15.1 | 0.05 |
| 24 | $Fe_{bal.}Cu_{0.9}Nb_3Si_{2.1}B_{13.1}$ | 15.5 | 0.18 |
| 25 | $(Fe_{0.81}Co_{0.19})_{bal.}Cu_1Nb_3Si_2B_{13}$ | 16.2 | 0.35 |

Note:
(1)Sample Nos. 17-23: Present invention Samples Nos. 24 and 25: Comparative Examples It is verified from Table 2 that by the addition of Ge, Ga, Al, N, C and P, the resulting alloys have less than one-half of coercive forces of Sample Nos. 24 and 25 which do not contain these elements, while retaining substantially the same saturation magnetic flux densities as those of Sample Nos. 24 and 25. Thus, the addition of the above elements is effective for low-frequency transformers.

EXAMPLE 8

An alloy melt having a composition (by atomic %) of $Fe_{79.5}Cu_1Si_4B_{12.5-\gamma}Nb_3P_\gamma$ was formed into a ribbon of 15 mm in width and 18 μm in thickness by a single roll method, and wound in a toroidal form of 25 mm in outer diameter and 20 mm in inner diameter. The resulting magnetic core was provided with heat-insulating windings, and electric current was applied thereto to generate a magnetic field of 5 Oe in the direction parallel to the magnetic path. Under this condition, the heat treatment was conducted such that it was heated to 530° C. at a heating rate of 5 ° C./min, kept at 530° C. for 1 hour, and then cooled at an average cooling rate of 2.5 ° C./min to room temperature. The heat treatment atmosphere was an $N_2$ gas.

The heat-treated core was contained in a phenol resin core case and provided with windings to measure DC magnetic properties. The results are shown in FIG. 6.

Figure 6:
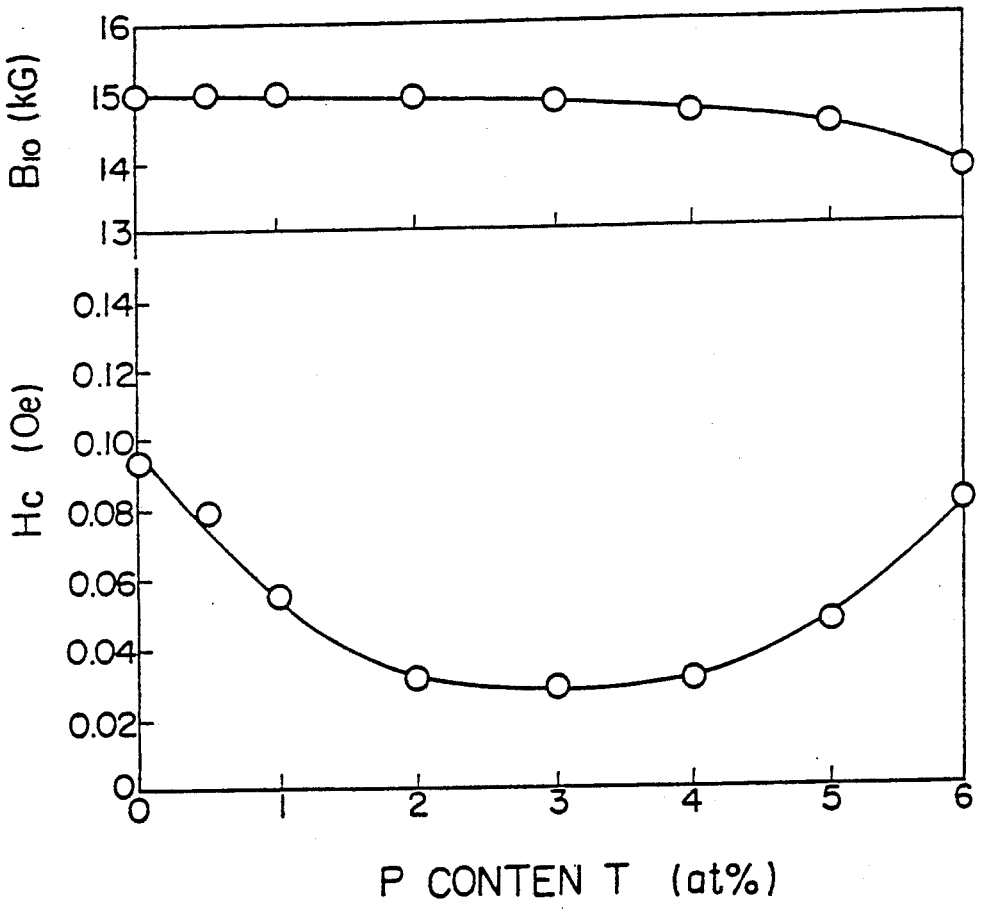
FIG. 6 is a graph showing the relations between magnetic properties and P content.

As is clear from FIG. 6, coercive force can be reduced by substituting P for part of B. When the amount of P exceeds 4 atomic %, the coercive force rather increases and saturation magnetic flux density decreases, which is undesirable tendency in terms of core loss and for the purpose of miniaturization of transformers.

As described above, the low-frequency transformers of the present invention are suitable for distribution transformers operated at commercial frequency and inverter transformers operated at low frequency of 10 kHz or less.

What is claimed is:

1. A low-frequency transformer comprising a magnetic core made of an alloy having the composition represented by the general formula:

$$(Fe_{1-a}M_a)_{100-x-y-z-\alpha}Cu_xSi_yB_zM'_\alpha \quad \text{(atomic \%)}$$

wherein M is Co and/or Ni, M' is at least one element selected from the group consisting of Nb, W, Ta, Mo, Zr, Hf and Ti, and a, x, y, z and α respectively satisfy $0 \leqq a \leqq 0.3$, $0.1 \leqq x \leqq 3$, $0 \leqq y \leqq 17$, $4 \leqq z \leqq 17$, $10 \leqq y+z \leqq 28$ and $0.1 \leqq \alpha \leqq 5$, at least 50% of the alloy structure being occupied by fine crystal grains having an average grain size of 1000Å or less when measured by their maximum diameters.

2. A low-frequency transformer comprising a magnetic core made of an alloy having the composition represented by the general formula:

$$(Fe_{1-a}M_a)_{100-x-y-z-\alpha-\gamma}Cu_xSi_yB_zM'_\alpha X_\gamma \quad \text{(by atomic \%)}$$

wherein M is Co and/or Ni, M' is at least one element selected from the group consisting of Nb, W, Ta, Mo, Zr, Hf and Ti, X is at least one element selected from the group consisting of Ge, P, C, Ga, Al and N, and a, x, y, z, α and γ respectively satisfy $0 \leqq a \leqq 0.3$, $0.1 \leqq x \leqq 3$, $0 \leqq y \leqq 10$, $4 \leqq z \leqq 17$, $0.1 \leqq \alpha \leqq 5$, $\gamma \leqq 4$ and $10 \leqq y+z+\gamma \leqq 20$, at least 50 % of the alloy structure being occupied by fine crystal grains having an average grain size of 1000Å or less when measured by their maximum diameters.

3. The low-frequency transformer according to claim 1, wherein said alloy satisfies $0 \leqq a \leqq 0.3$, $0.5 \leqq x \leqq 2$, $0 \leqq y \leqq 15$, $7 \leqq z \leqq 15$, $15 \leqq y+z \leqq 25$ and $1 \leqq \alpha \leqq 3$.

4. The low-frequency transformer according to claim 2, wherein said alloy satisfies $0 \leqq a \leqq 0.3$, $0.5 \leqq x \leqq 2$, $0 \leqq y \leqq 10$, $7 \leqq z \leqq 15$, $10 \leqq y+z+\gamma \leqq 20$, $1 \leqq \alpha \leqq 3$, and $0.1 \leqq \gamma \leqq 3$.

5. The low-frequency transformer according to claim 1 or 2, wherein the balance of said alloy structure is substantially amorphous.

6. The low-frequency transformer according to claim 1 or 2, wherein said alloy structure substantially consists of fine crystal grains.

7. The low-frequency transformer according to claim 1, wherein the average grain size of said fine crystal grains is 500Å or less.

8. The low-frequency transformer according to claim 1, wherein said alloy has a saturation magnetic flux density Bs of 13 kG or more.

* * * * *